United States Patent [19]

Livneh

[11] Patent Number: 4,703,536

[45] Date of Patent: Nov. 3, 1987

[54] FLUID MOTOR DRIVEN WASHING ACCESSORY

[76] Inventor: Zvi Livneh, 3290 Avondale, Windsor, Ontario, Canada, N9E 1X6

[21] Appl. No.: 4,234

[22] Filed: Jan. 7, 1987

Related U.S. Application Data

[63] Continuation of Ser. No. 772,151, Sep. 3, 1985, abandoned.

[51] Int. Cl.[4] ..... A61H 33/00; A46B 13/06

[52] U.S. Cl. ..... 15/97 R; 15/22 R; 51/170 R; 74/89.12; 128/50

[56] References Cited

U.S. PATENT DOCUMENTS

| | | | |
|---|---|---|---|
| 2,905,171 | 9/1959 | De Crescenzo | 128/53 |
| 3,283,352 | 11/1966 | Hu | 15/22 |
| 3,443,271 | 5/1969 | Lyons | 15/22 R |
| 3,932,909 | 1/1976 | Johnson et al. | 15/29 |
| 4,417,826 | 11/1983 | Floros | 401/41 |
| 4,458,676 | 7/1984 | Pileggi | 128/53 |
| 4,471,503 | 9/1984 | Smyth | 15/22 R |

*Primary Examiner*—Edward L. Roberts

*Attorney, Agent, or Firm*—Harness, Dickey & Pierce

[57] ABSTRACT

The present invention discloses a fluid driven washing device having a pressurized fluid supply conduit for supplying fluid to the device. The device is comprised of a handle portion, an assembly for producing reciprocating motion in the device, a control mechanism for controlling the reciprocating motion of the assembly, and a scrubbing member in communication with the reciprocating motion assembly, wherein the reciprocating motion assembly drives the scrubbing member in a rotating reciprocal motion. Mechanisms are also disclosed for supplying soap to the scrubbing member in a desired amount and integrating a shower head into the device.

19 Claims, 14 Drawing Figures

FLUID MOTOR DRIVEN WASHING ACCESSORY

This is a continuation of U.S. patent application Ser. No. 772,151, filed Sept. 3, 1985, now abandoned entitled "Fluid Motor Driven Washing Accessory".

This invention relates to fluid motor driven washing devices and, more particularly, to devices having rotating reciprocating washing members.

BACKGROUND

The prior art of fluid driven washing brushes teaches rotary action, vibratory action, and reciprocating action, as well as soap dispensing and combinations thereof. U.S. Pat. Nos. 4,417,826 (Floros), 3,932,909 (Johnson), 4,189,801 (Lanusse), and 3,283,352 (Hu) exemplify varying forms of rotatably brushes. The patents to Floros and Johnson also include soap dispensing devices. U.S. Pat. Nos. 4,471,503 (Smyth), 4,458,676 (Pileggi), and 2,905,171 (De Crescenzo) exemplify varying forms of vibrating brushes. U.S. Pat. No. 3,443,271 (Lyons) discloses a reciprocating brush.

The above-identified prior art patents teaching fluid driven washing brushes have, however, several disadvantages. The rotary brushes, while having good scrubbing action, can become entangled with body hair, while in use. Also, the rotary brushes consume an excessive amount of fluid per stroke in their operating mode relative to the present invention. The vibratory brushes, while less likely to entangle with body hair, do not have as effective scrubbing action. Although the reciprocating brushes are less likely to entangle with body hair and have good scrubbing action, they produce an irritating linear scrubbing motion.

SUMMARY OF THE INVENTION

The present invention involves a fluid driven washing device having rotational reciprocating motion. The fluid driven washing device having a fluid supply source is comprised of a hollow body member having a handle extending therefrom, means for providing the washing device with reciprocating motion, means for controlling the reciprocating motion means, scrubbing means rotatably mounted on the body member, and means for imparting reciprocating motion to the scrubbing means to drive the scrubbing member in a rotational reciprocating motion.

More particularly, the reciprocating motion means is comprised of a cylinder, a plurality of ports in the cylinder in communication with a fluid supply from the controlling means to enable the supply fluid to enter and exit the piston cylinder, and a reciprocating piston member positioned in the cylinder. Fluid enters and exits the cylinder through the ports to drive the piston in a reciprocating motion in the cylinder. A linkage rod between the piston member and the scrubbing member is also included to drive the scrubbing members in a rotational reciprocating motion.

The control means in the preferred embodiment is comprised of a pair of chambers each having a plurality of ports therein. At least one of the ports in each chamber communicates with the fluid supply source. The ports provide each chamber with a gate means for enabling the fluid to enter and exit the ports. At least one of the ports in each chamber communicates with the reciprocating means. A means for opening and closing the ports in each chamber is preferably rotatably mounted in each chamber for opening one chamber while closing the other chamber. Both the chambers and the gate means are connected with a suitable mechanism in a systematic manner to assure mutual alignment of flow through the chambers. Alternate embodiments are also disclosed.

With the piston member in its "down" position, fluid enters one of the control chambers, passes through the chamber, through a conduit, and into the bottom of the piston cylinder. This action forces the piston and linkage upward, rotating the scrubbing member in a first direction. Concurrently, the fluid in the top of the cylinder is being evacuated by the movement of the piston through the second chamber. When the means for opening and closing the chambers switches, the fluid flow reverses to force fluid into the top of the piston cylinder, driving the piston downward to rotate the scrubbing member in the opposite direction. While moving in a reciprocating movement, a linkage bar attached to a piston rod activates an energy storage device to achieve a trigger effect to position the gate means associated with the chambers.

The present invention overcomes the disadvantages of the prior art described above while also having several other advantages. The present invention is lightweight and can be made entirely of plastic materials, except for one spring. The scrubbing member is readily removable so that each user can be provided with his own sponge to comply with personal preference as to the type or texture of sponge to be used and also reduce the risk of communication between users. The reciprocating rotation of the scrubbing member does not present the problem of entanglement of body hair that is present with rotary brushes. Also, the present invention utilizes less fluid, approximately 0.6–0.8 gal/min., than prior art devices during operation to achieve the same number of strokes per second, thus, substantially conserving the fluid, since the force per water volume is greater and the water energy is more efficiently used than the prior art devices set forth above. All of these advantages are provided in a unit having its manually-operated controls easily accessible to the same hand of the user that is holding the device, although some user's may prefer a two-handed procedure.

Other advantages of the present invention will become apparent to one skilled in the art upon reading the following specification and by referring to the drawings.

DETAILED DESCRIPTION OF THE PREFERRED EMBODIMENTS

Figure 1:
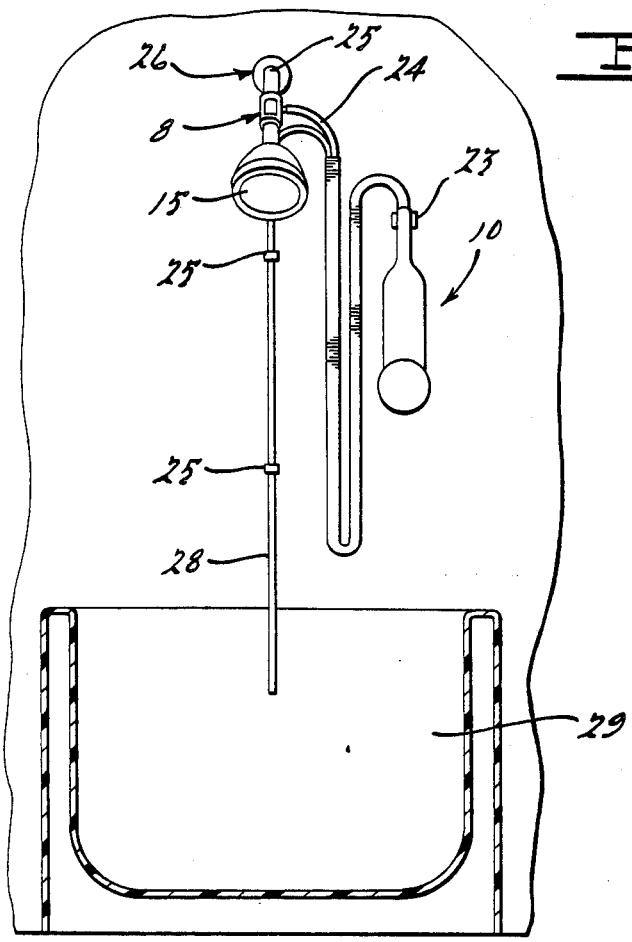
FIG. 1 is an elevated view of a fluid driven device of the present invention mounted to an overhead shower.
Figure 2:
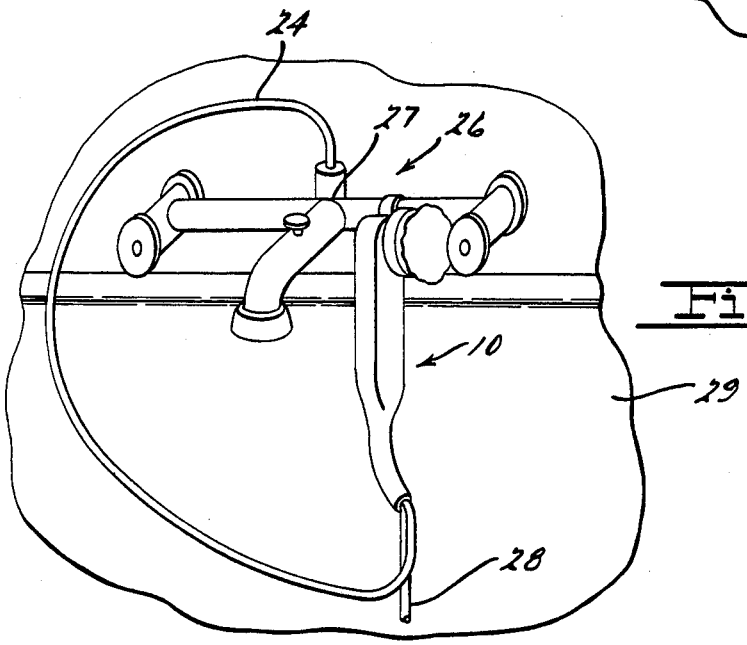
FIG. 2 is an elevated view of a fluid driven washing device of the present invention mounted to a manual shower.
Figure 3:
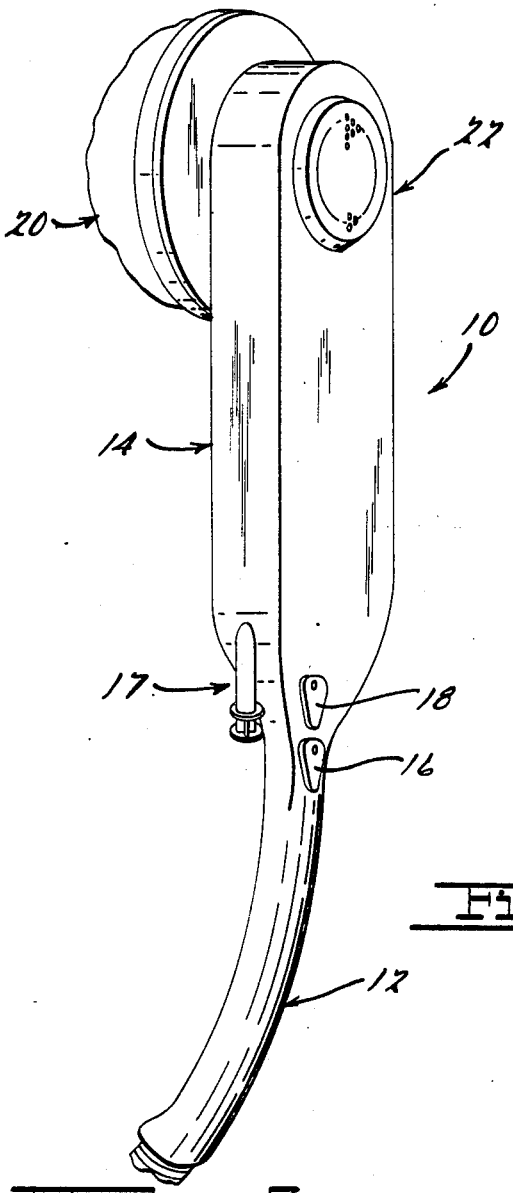
FIG. 3 is an elevated view of the fluid driven washing device of the present invention.

Referring to FIGS. 1 through 3, a fluid driven washing device 10 of the present invention is shown. The device 10 has a handle portion 12, a body portion 14, a fluid control lever 16, a soap injection mechanism 17, a dilution control lever 18, a scrubbing member 20, and a spraying member 22. A supply conduit 24 is connected between the device 10 and a fluid source 26 for supplying fluid to the device 10, such as a shower pipe 25 (FIG. 1) or faucet pipe 27 (FIG. 2). A return conduit 28 is connected to the device 10 for returning the working fluid to a bath tub 29, and into the drain of that bath tub 29.

Figure 13:
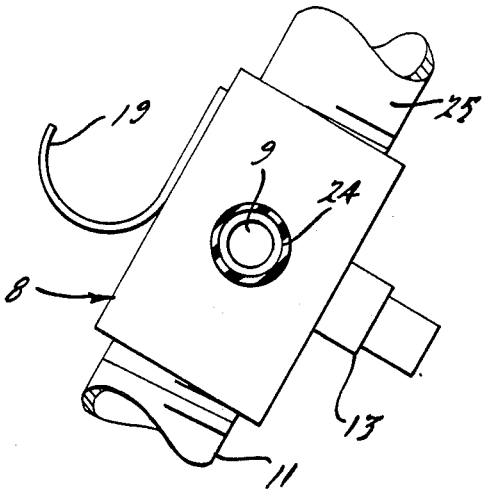
FIG. 13 is an elevational view of the fitting at the shower head of FIG. 1.

A collar member 8 employed with the device 10 as used in FIG. 1 is shown enlarged in FIG. 13, having an exit port 9 with the supply conduit 24 attached thereto. The collar 8 has conventional interior threads to secure the collar 8 onto a conventional shower pipe 25. The collar 8 also has an extended threaded portion 11 for threadably securing a conventional shower head 15 to the collar 8. A control valve 13 is disposed on the collar 8 for determining the flow of the fluid into the supply conduit 24 or to the conventional shower head 15 (FIG. 1). A hook 19 may be positioned on the collar 8 for hanging the washing device 10 via a cooperative element (not shown) on the device 10 or via the base 21 containing the supply conduit 24 and the return conduit 28. Alternatively, the device 10 may be attached to the wall via a spring clip 23 (FIG. 1) or similar device. The return conduit 28 should also be stabilized by a plurality of clips 25 mounted on the wall.

Figure 4:
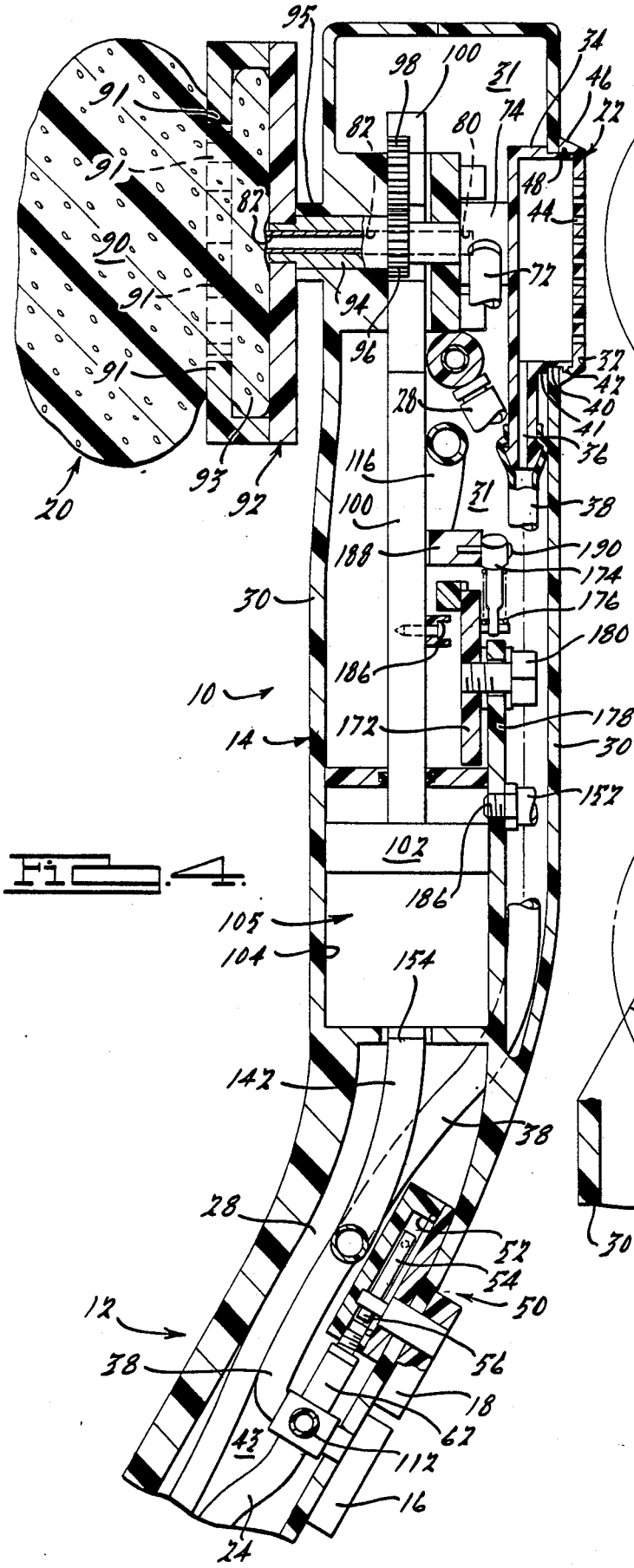
FIG. 4 is a cross-sectional view of FIG. 3 with the lower portions of the housing removed.

Referring to FIG. 4, the device 10 has a body portion 14 and handle portion 12. Both portions 12 and 14 are enclosed by a housing 30 forming a body cavity 31. The housing 30 provides the washing device 10 with a compact, handy, sleek appearance.

The sprayer member 22 is positioned on the housing 30 opposite the scrubber member 20. The sprayer member 22 is comprised of a plate 32 and a sprayer body 34, having an inlet port 36. The inlet port 36 is connected to a supply conduit 38 to provide pressurized fluid to the sprayer member 22. The sprayer body 34 has an annular groove 40 positioned about its exterior surface between an annular lip 41 and an annular flange 42 for snap fitting the sprayer body 34 into the housing 30.

The sprayer plate 32 has a plurality of apertures 44 in its circular planar surface for feeding pressurized fluid out of the device 10 and onto the user. The sprayer plate 32 has a circumferential flange 46, which, in turn, has an interior groove 48 on the interior surface of the flange 46, for securing the sprayer plate 32 onto the sprayer body 34. The sprayer plate 32 is snap fit onto the sprayer body 34 by interlocking the sprayer body flange 42 into the sprayer plate groove 48.

Figure 14:
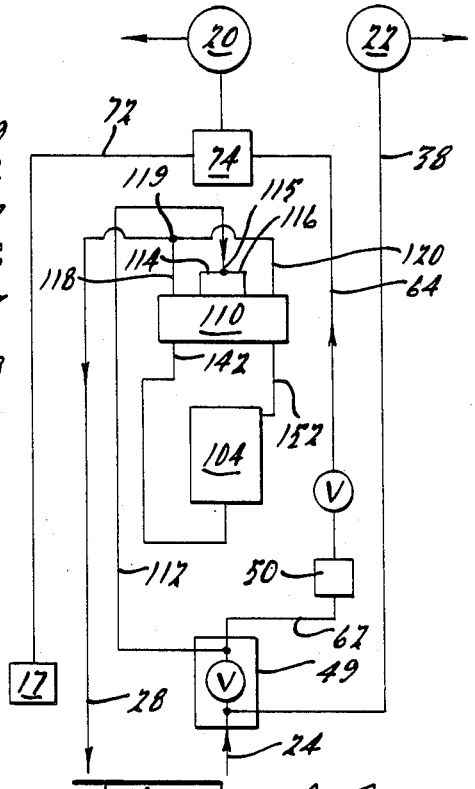
FIG. 14 is a schematic diagram of the fluid paths and controls of the present invention.

The hollow interior chamber 43 of the handle portion 12 acts as a passageway for several conduits, including the supply and return conduits 24 and 28 (FIG. 14). The handle 12 is canted with respect to the body 14 at an angle of about 15° to 30° to provide the device 10 with appealing kinesthetic effects. A manifold and control valve 49 (FIGS. 4 and 14) is disposed in the handle for separating the supply conduit 24 into a plurality of supply conduits (38, and 112 or 62) for operating the device. The manifold and valve 49 is controlled by the user via control lever 16.

Figure 5:
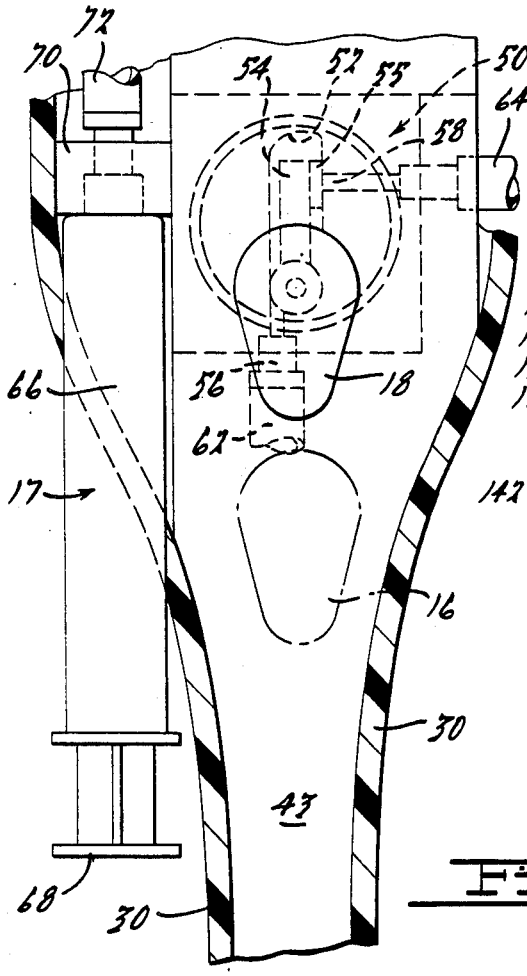
FIG. 5 is an elevated view of the handle portion of the device of FIG. 4 with portions of the housing removed.

A dilution mechanism 50 is also positioned on the handle 12. The dilution mechanism 50 comprises the lever 18, a chamber 52 having an inlet port 56 and an exit port 58, and an arm 54 having a flexible end element 55 (FIGS. 4 and 5). The lever 18 is pivotally mounted on the handle 12 by a pivot pin 60 which also pivots the arm 54. Supply conduit 62 supplies fluid to the chamber 52 through inlet port 56. The fliud pressure of the fluid entering the chamber 52 holds the arm 54 against the exit port 58 (FIG. 5). When the lever 18 is rotated (counterclockwise in FIG. 5), exit port 58 opens enabling the fluid in the chamber 52 to exit into a conduit 64 to a mechanism for placing dilution water onto the scrubber member 20 as will be described below.

Referring to FIGS. 3 and 5, the soap injection mechanism 17 comprises a storage cylinder 66 and a plunger 68. The storage cylinder 66 is secured to the housing 30 by a conventional framing mechanism 70 and is filled with liquid soap or a liquid soap mixture. When the plunger 68 is pushed, the soap or soap mixture exits into a conduit 72 communicating with the scrubbing member 20. The amount of soap or soap mixture supplied is determined by the disposition of the plunger as set by a series of interference stops within the cylinder which positively click as the plunger passes each stop and hold the plunger in a selected position.

Figure 8:
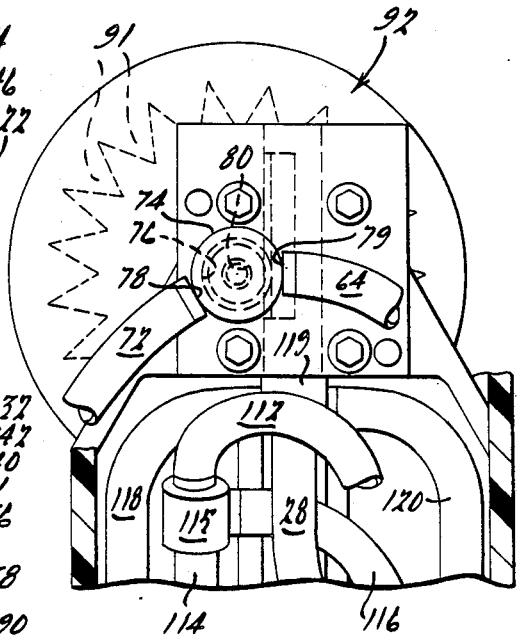
FIG. 8 is a rear elevated view of the conduit arrangment at the upper portion of the device illustrated in FIG. 4 with portions of the housing removed.

The soap conduit 72 and the dilution conduit 64 intersect and also communicate with the scrubbing member 20 at a dilution manifold 74 (FIGS. 4 and 8). The dilution manifold 74 comprises a chamber 76, a pair of entrance ports 78 and 79, and an exit port 80. The conduits 64 and 72 are secured to the entrance ports 78 by conventional fittings. The conduits 64 and 72 provide soap and fluid to the scrubber member 20 via the exit port 80, in communication with the chamber 76, communicating with a passageway 82 which, in turn, feeds into the interior of the scrubbing member 20. The dilution manifold 74 supplies the scrubbing member 20 with a soap and dilution fluid in successive steps as discussed in more detail below.

As illustrated in FIG. 4, the scrubbing member 20 comprises a cleaning element 90 and a holding element 92. The holding element 92 may be a single part or an assembly integrated by conventional means. The cleaning element 90, a sponge in the preferred embodiment, is detachably mounted to the holding element 92 by means of a series of inwardly directed pointed ribs 91 disposed circumferentially around the element 92 (FIG. 8) which engage by press fit an annular lip 93 on the sponge 90.

Figure 9:
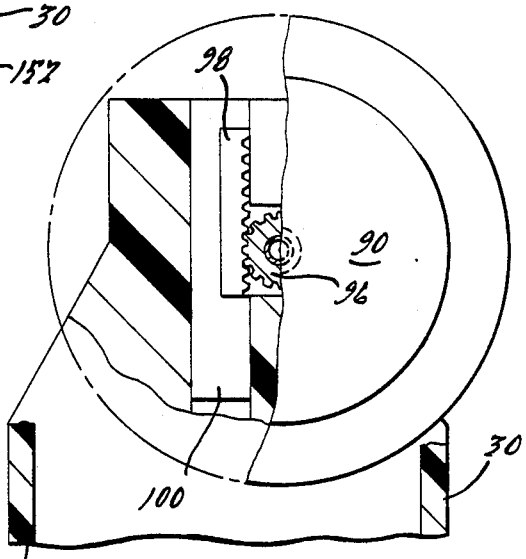
FIG. 9 is a front cross-sectional view partially in elevation of the scrubbing member interface with the drive assembly.

The holding element 92 has a pivot shaft 94 extending therefrom. The pivot shaft 94 has passageway 82 passing through it and is rotatably secured in the housing 30 at a bearing 95. As shown in FIGS. 4 and 9, a pinion gear 96 is disposed on the pivot shaft 94 in the interior body cavity 31 and engages a rack gear 98 positioned on an extended rod 100. The rod 100, in communication with a fluid actuator, such as a hydraulic piston assembly 105, drives the rack 98, which, in turn, rotates the pinion gear 96, thus generating reciprocating rotational movement in the scrubbing member 20.

The rod 100 communicates with a piston member 102 as part of a fluid actuator. The piston member 102 is positioned in a cylinder 104 in the body portion 14 of the device 10. The hydraulic piston assembly 105 is driven in a reciprocating linear motion.

Figure 6:
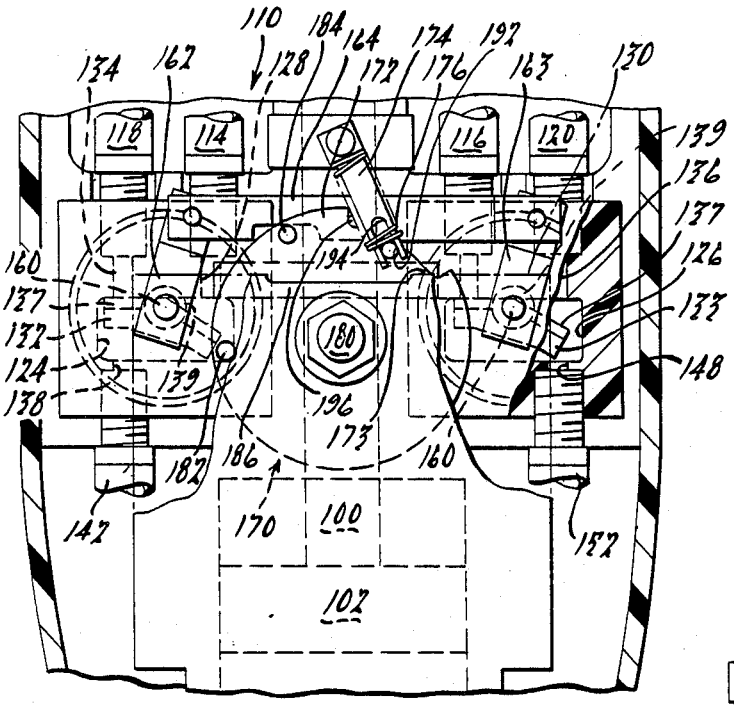
FIG. 6 is an elevated view partially in section of the drive assembly of the device in a first intermediate position.
Figure 7:
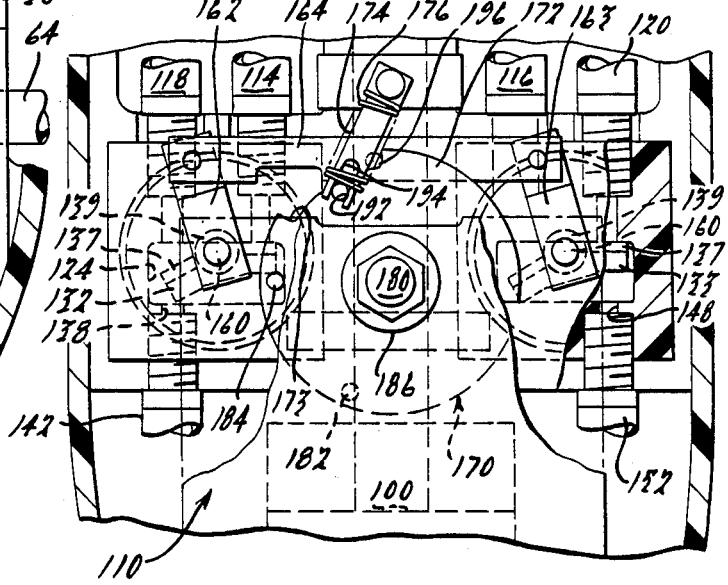
FIG. 7 is the same view as FIG. 6 with the drive assembly of the device in a second intermediate position.

The hydraulic piston assembly 105 is controlled by a hydaulic drive assembly 110 (FIG. 6 or 7). Referring to FIG. 8, a supply conduit 112 from the manifold and valve 49 is divided into tow conduits 114 and 116 by a T-shaped manifold 115 to supply fluid to the drive assembly 110. The drive assembly 110 has a pair of return conduits 118 and 120, commonly joined by a second T-shaped manifold 119. These conduits 118 and 120 feed into the drain conduit 28 to return the working fluid to the drain of the bath tub 29.

The drive assembly 110 in accordance with the present invention, as shown in FIGS. 6 and 7, comprises supply conduits 114 and 116 communicating with chambers 124 and 126, respectively, through ports 128 and 130, gate members 132 and 133 positioned in each chamber 124 and 126, as will be described below, and return conduits 118 and 120 in communication with the chambers 124 and 126, respectively, through ports 134 and 136. The assembly 110 also includes port 138 in chamber 124 which communicates with conduit 142, which, in turn, communicates with the piston cylinder 104, and port 148 in communication with chamber 126, which communicates with conduit 152, which also communicates with the piston cylinder 104. Conduit 142 is fitted to port 154 at the bottom portion of the piston cylinder 104 and conduit 152 is fitted to port 156 in the upper portion of the piston cylinder 104 (FIG. 4).

The device 10 operates as follows: With the piston 102 in its "down" position, fluid in conduit 114 passes through chamber 124, through conduit 142, through port 154, into the bottom of the piston cylinder 104, forcing the piston 102 and rod 100 upward (FIGS. 4 and 6). While this is occurring, the fluid in the top portion of the piston cylinder 104 is forced by the piston 102 through port 156, into conduit 152, through chamber 126, through conduit 120, and through drain conduit 28 into the bath tub.

Once the piston 102 is in its "up" position, it must be reciprocated back to its "down" position. The fluid in conduit 116 passes through chamber 126, through conduit 152, through port 156, into the top portion of the piston cylinder 104, forcing the piston 102 and rod 100 downward (FIG. 7). While this is occurring, the fluid in the bottom portion of the piston cylinder 104 passes through port 154, conduit 142, chamber 124, conduit 118, and drain conduit 28 into the bath tub. The flow of the fluid through the chambers 124 and 126 and the piston cylinder 104 is controlled by the gate members 132 and 133.

The gate members 132 and 133 are rotatably secured by pins 160 in the chambers 124 and 126, respectively. The pins 160 are securely mounted to bar linkages 162 and 163 such that bar linkage 162 and gate member 132 move together and bar linkage 163 and gate member 133 move together. The bar linkages 162 and 163 are rotatably mounted to a main bar linkage 164. The movement of the main bar linkage 164 provides the gate members 132 and 133 in chambers 124 and 126, respectively, with opening and closing action of the fluid inlet ports 128 and 130, and, respectively, for outlet ports 118 and 120.

Each of the gate members 132 and 133 each comprise an angulated member having a sealing surface 137 along one side thereof and a securing portion 139 for securing the member 135 to the pins 160 while still allowing rotation. The member 132 or 133 is bent at a selected angle for opening and closing the desired ports upon the movement of the bar linkages. In the present embodiment, this angle is approximately 120 degrees.

The main linkage bar 164 moves within a yoke assembly 170. The yoke assembly 170 includes a yoke disc 172, a pivoted rod member 174, and a resilient biasing member 176. Referring to FIG. 4, the yoke disc 172 is rotatably mounted on a flange 178 disposed in the body cavity 31 by a conventional bolt fastener 180.

The yoke disc 172 has a pair of pins 182 and 184 (FIGS. 6 and 7) extending from its rear surface for enhancing movement of the yoke disc 172. The yoke disc 172 also has a circumferential slot 173 in which is disposed a pin 196 attached to the main linkage bar 164. A bar 186, (FIGS. 4, 6 and 7) secured to the piston rod 100, contacts the pins 182 and 184 as the rod 100 moves up and down to rotate the yoke disc 172. The rod member 174 is pivotally mounted on a flange 188 (FIG. 4) in the body cavity 31 by a conventional fastener 190 and is also pivotally secured to the yoke disc 172 by a pin 192.

The rod member 174 has a second linear yoke 194. A pin 192, fixedly secured to the yoke disc 172, is positioned within the yoke 194. The positioning of the pin 192 enables the yoke disc 172 to communicate with the rod member 174. The resilient biasing member 176, preferably a helical spring, positioned coaxially with and around the rod member 174, is held in place on the rod member 174 at one end by the pin 190 of the rod member 174 and at other end by the pin 192 of the yoke disc 172.

The rotation of the yoke disc 172 moves the pin 192 along an arcuate path against the spring 176 within the yoke 194 of the rod member 174. The pin 196 remains within the slot 173 and the slot 173 moves with the yoke disc 172 without moving the linkage bar pin 196 or the main linkage bar 164 until the rod member 174 passes its vertical position beyond which position the energy stored in the spring 176 is rapidly released. The yoke disc 172 is rapidly rotated and the slot 173 forces the pin 196 and the main linkage bar 164 to a new position. In this manner, the ports in the chambers 124 and 126, respectively, are opened and closed, since the bar 164 only travels to one of two positions. The yoke disc 172 actuates the switch members 132 and 133 between two to four times per second, producing two to four reciprocating rotational strokes of the scrubbing member per second. For example, when fluid enters the chamber 124, the switch 132 is in an "open" position uncovering entrance port 128 (as shown in FIG. 6). As the piston cylinder 104 fills with fluid, the bar 186 will push on pin 184 forcing the yoke disc 172 to rotate in a clockwise direction and store energy in the spring 176. As rod member 174 passes beyond its vertical position, the spring 176 releases its stored energy. This action rapidly moves the pin 196 and thereby the main linkage bar 164 to its alternate position to reverse the switch member 132 from an "open" to "closed" position on the port 128 and the port 130 in chamber 126 is opened to return the switch 132 to its open position the following occurs. As the piston cylinder 104 fills with fluid, the bar 186 will push on pin 182, forcing the yoke disc 172 to rotate in a counterclockwise direction storing energy in the spring 176. As the rod member 174 passes beyond its vertical position, the spring 176 releases its stored energy. This action rapidly moves the pins 196 and thereby the main linkage bar 164 to its alternate position to reverse the switch member 133 from an "open" to "closed" position on port 130 and the port 128 in chamber 124 is opened.

The process is continued in chamber 126 as described above utilizing the corresponding components in chamber 126. This reciprocating movement continues until the device is deactivated by lever 16 controlling the directional control valve that directs water to either the shower or the soaper.

Figure 10:
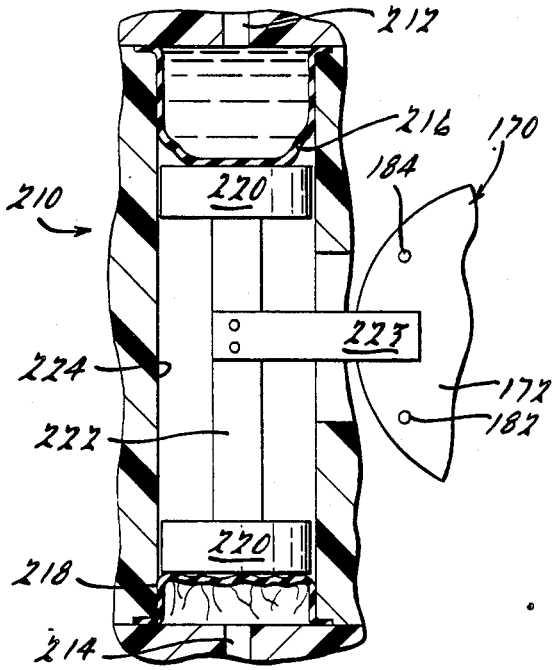
FIG. 10 is a cross-sectional view of an alternative embodiment of the drive assembly.
Figure 11:
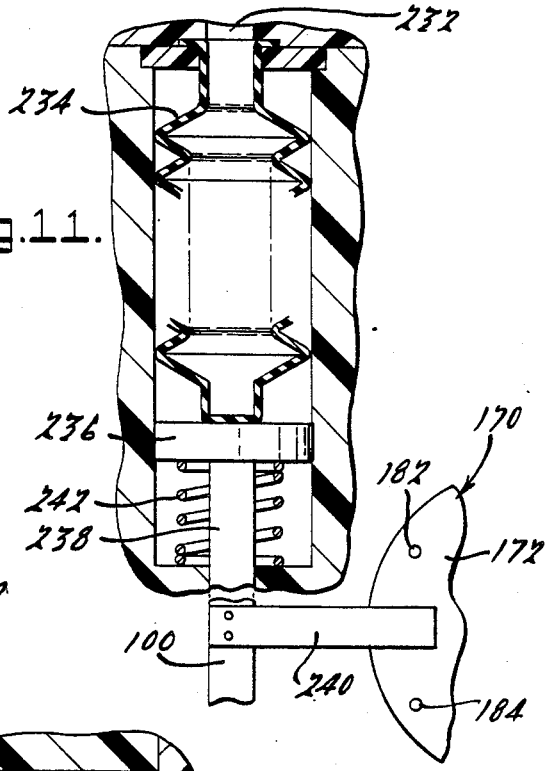
FIG. 11 is a cross-sectional view of a further alternative embodiment of the drive assembly.
Figure 12:
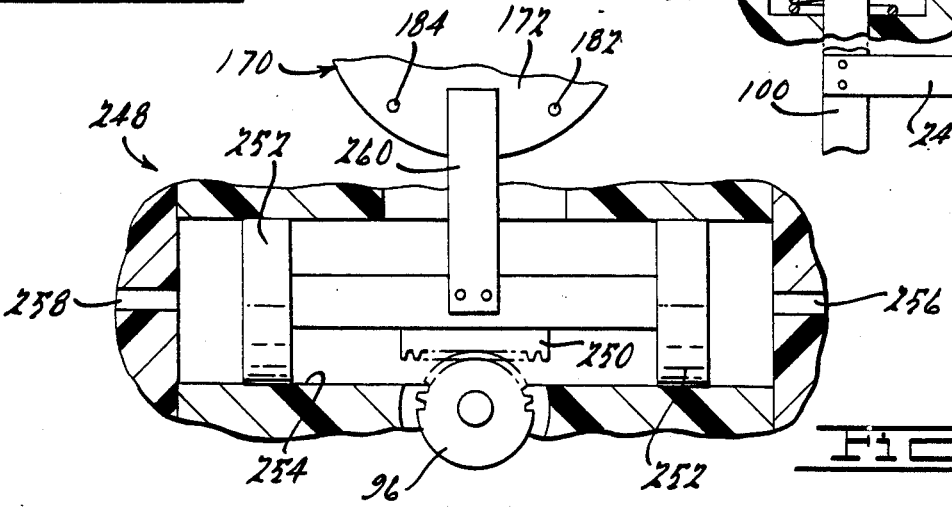
FIG. 12 is a cross-sectional view of another alternative embodiment of the drive assembly.

FIGS. 10 through 12 illustrate alternate embodiments of the piston assembly 105. In FIG. 10, a diaphragm assembly 210 comprising ports 212 and 214, diaphragms 216 and 218, a piston member 220, and a linkage rod 222 having a bar 223 mounted as shown. The fluid successively enters and exits ports 212 and 214, forcing the piston member 220 to reciprocally move in the cylinder 224. The reciprocal movement actuates the rod 222 driving rack 98 (via an additional mechanism not shown), which, in turn, produces reciprocating rotatable movement in the scrubbing member 20 while also moving the bar 223 betwen pins 182 and 184 to move the yoke assembly 170 and control the piston assembly 105.

A bellows-spring assembly 230 is illustrated in FIG. 11. The bellows-spring assembly 230 comprises a port 232, a bellows member 234, a piston 236, a rod 238, a bar 240, and a return spring 242. The fluid enters port 232 forcing fluid into bellows 234, expanding the bellows 234 to actuate the piston 236. The piston 236 moves the rod 238 which, in turn, drives the rack 98 via extended rod 100, producing reciprocating rotatable movement in the scrubbing member 20. A gate member such as that indicated by the numeral 132 and 133 (in FIGS. 6 and 7) reverses to cut off the flow into the piston cylinder. This action opens the return conduit. The spring 242 expands, compressing the bellows member 234, forcing the fluid out port 232, returning the rod 238, the rod 100, and bar 240 to their former positions. With this embodiment, only one control chamber with three conduits and one gate member would be needed.

A horizontally disposed piston assembly 248 is illustrated in FIG. 13. The assembly 248 comprises a rack 250, a pair of pistons 252 and 253, moving within a cylinder 254, and ports 256 and 258, one at each end of the cylinder 254. The rack 250 drives the pinion 96 to drive the scrubbing member 20. The fluid successively enters and exits ports 256 and 258, respectively, forcing the rack 250 to drive the scrubbing member 20 in a rotating reciprocal motion. The linkage bar 260 rotates the yoke disc 172 as described above to control the piston assembly 105.

While it will be apparent that the preferred embodiments of the invention disclosed are well calculated to provide the advantages and features above stated, it will be appreciated that the invention is susceptible to modification, variation and change without departing from the spirit and scope of the invention, as defined by the appended claims.

I claim:

1. A fluid driven washing device having a pressurized fluid supply conduit for supplying fluid to said device, said conduit being in communication with a pressurized fluid source, said device comprising:

a housing having a handle portion extending therefrom and an interior chamber;

linear reciprocating means disposed within said housing driven by said pressurized fluid;

scrubbing means rotatably mounted on said body member;

means in communication with said linear reciprocating means for driving said scrubbing means in a rotating reciprocal motion; and means for controlling said driving means in communication with said driving means and said fluid supply conduit.

2. The device of claim 1, wherein said linear reciprocating means is comprised of a hydraulic piston assembly including a cylinder having a plurality of ports in communication with said controlling means, said ports enabling fluid to enter and exit said piston assembly, a reciprocating piston member positioned in said cylinder, and a rod member associated with said piston member and coupled by a means for transmitting linear motion into rotary motion with said scrubbing means, wherein said fluid enters and exits said piston cylinder driving said piston in a linear reciprocating motion in said cylinder which linearly drives said rod member which, in turn, drives said scrubbing means in said rotating reciprocal motion.

3. The device of claim 2, wherein said means for transmitting linear motion to rotary motion comprises pinion gear means positioned on a pivot associated with said scrubbing means, rack gear means positioned on said rod member engaged with said pinion gear means for driving said scrubbing means with rotary reciprocating motion.

4. The device of claim 1, wherein said control means comprises a pair of chambers having a plurality of ports, at least one of said ports in each chamber being in communication with said supply conduit, at least one of said ports in each chamber being in communication with said linear reciprocating means, means for opening and closing each said port, said opening and closing means being in communication with said supply conduit in each chamber, and said opening and closing means pivotally mounted in each of said chambers for enabling supply fluid to enter one chamber while enabling fluid to exit the other chamber.

5. The device of claim 4, wherein said opening and closing means in each chamber being associated with energy storage means for rapidly transferring said opening and closing means from an open position to a closed position in each of said chambers.

6. The device of claim 1, wherein said linear reciprocating means comprises a cylinder having a pair of ports in communication with said controlling means, said ports enabling fluid to enter and exit said cylinder, a pair of diaphragm members positioned in said cylinder and each in communication with one of said fluid ports, a piston member positioned in said cylinder between said pair of diaphragm members, and a rod member associated with said piston member and coupled by a means for transmitting linear movement to rotary movement with said scrubbing means, wherein said fluid enters and exits said piston cylinder driving said diaphragm members and piston member in a linear reciprocating motion in said cylinder which drives said rod member which, in turn, drives said scrubbing means in said rotating reciprocal motion.

7. The device of claim 1, wherein said reciprocating means comprises a cylinder having at least one port in communication with said controlling means, said port enabling the fluid to enter and exit said cylinder, a bellows member positioned in said cylinder and in communication with said at least one fluid port, a piston member positioned in said cylinder, biasing means in communication with said piston member, said bellows member and biasing means combining to drive said piston member in a reciprocating motion in said cylinder and a rod member associated with said piston member and coupled by a means for transmitting linear motion into rotary motion with said scrubbing means, wherein said fluid enters and exits said bellows member driving said piston in a linear reciprocating motion in said cylinder which drives said rod member which, in turn, drives said scrubbing means in said rotating reciprocal motion.

8. The device of claim 1, wherein said reciprocating means comprises a cylinder having a pair of ports in communication with said supply conduit, said ports enabling fluid to enter and exit said cylinder, a pair of piston members linked together by a bar member being positioned in said cylinder, said bar member including a rack member, said rack member associated with a pinion member, said pinion member associated with said scrubbing member, wherein fluid enters and exits said cylinder driving said pistons, bar member and rack member in a linear reciprocating motion in said cylinder which, in turn, drives said scrubbing means in said rotating reciprocal motion.

9. A fluid driven washing device having a pressurized fluid supply conduit for supplying pressurized fluid to said device, said supply conduit being in communication with a pressurized fluid source, said device comprising:

a housing having a handle extending therefrom;

linear reciprocating means disposed within said housing driven by said pressurized fluid;

means in communication with said supply conduit for controlling said reciprocating means;

a scrubbing member;

means coupled with said reciprocating means for driving said scrubbing member in a reciprocating rotational motion;

means in communication with said scrubbing member for providing a soap solution to said scrubbing member; and means for providing fluid to said scrubbing member in communication with said supply conduit and said soaping means.

10. The device of claim 9, wherein said reciprocating means is comprised of a hydraulic piston assembly comprising a cylinder having a plurality of ports in communication with supply fluid of said controlling means, said ports enabling the supply fluid to enter and exit said piston assembly, and a reciprocating piston member positioned in said cylinder, and a rod member associated with said piston member and coupled by a means for transmitting linear motion into rotary motion with said scrubbing means, wherein said fluid enters and exits said piston cylinder driving said piston in a linear reciprocating motion in said cylinder which linearly drives said rod member which, in turn, drives said scrubbing means in said rotating reciprocal motion.

11. The device as in claim 10, wherein said means for transmitting linear motion to rotary motion comprises pinion gear means positioned on a pivot associated with said scrubbing means, and rack gear means positioned in communication with said pinion gear means for driving said scrubbing member and providing said scrubbing member with rotational reciprocating motion.

12. The device as in claim 9, wherein said control means comprises a pair of chambers each having a plurality of ports, at least one of said ports in each chamber being in communication with said supply conduit, said ports providing said chambers with a means for enabling fluid to enter and exit each said chamber, at least one of said ports in each chamber being in communication with said linear reciprocating means, means for opening and closing selected of said ports, said opening and closing means being in communication with said supply conduit in each chamber, and said opening and closing means pivotally mounted in each of said chambers for enabling supply fluid to enter one chamber while enabling fluid to exit the other chamber.

13. The device as in claim 12, wherein said opening and closing means in each chamber being associated with energy storing means for rapidly transferring said opening and closing means from an open position to a closed position in each of said chambers.

14. The device as in claim 9, wherein the soap providing means comprises means for storing said soap solution, and means for evacuating the soap solution out of the storing means through a soap conduit and into said scrubbing member.

15. A fluid driven washing device having a pressurized supply conduit for supplying fluid to said device, said supply conduit being in communication with a pressurized fluid source, said device comprising:

a housing having a handle portion and an interior chamber;

a piston assembly for providing linear reciprocal motion;

a pair of chambers each having a plurality of ports and each having means for alternately opening and closing a supply port and an exhaust port in each chamber, said supply ports in said chambers in communication with said supply conduit, at least one port in each of said chambers in communication with said piston assembly;

a scrubbing member rotatably disposed on said housing;

means communicating between said scrubbing member and said piston assembly for converting said linear reciprocal motion of said piston into reciprocating rotational motion of said scrubbing member;

soaping means in communication with said scrubbing member for providing said scrubbing member with a soap solution;

a sprayer head assembly mounted on said body member in communication with said supply conduit for spraying fluid from said head assembly; and means for directing fluid alternately to said sprayer head assembly or said chambers.

16. The device of claim 15, wherein said piston assembly comprises a cylinder having a plurality of ports in communication with supply fluid of said controlling means, said ports enabling the supply fluid to enter and exit said piston assembly, a reciprocating piston member disposed within said cylinder, wherein said fluid alternately enters and exits said piston cylinder to drive said piston in a reciprocating motion in said cylinder.

17. The device of claim 15 wherein said directing means includes a control located on said handle.

18. The device of claim 15, wherein said soaping means includes a soap dispenser communicating with said scrubbing member, control means for depositing soap from said dispenser onto said scrubbing member, and means for diluting said soap deposited on said scrubbing member with water including means located on said handle for controlling the amount of dilution water provided.

19. A control mechanism for a fluid driven washing device having a pressurized fluid supply conduit for supplying fluid to said device, said conduit being in communication with a pressurized fluid source, said device including a housing having a handle portion extending therefrom and an interior chamber; linear reciprocating means disposed within said housing driven by said pressurized fluid; scrubbing means rotatably mounted on said body member; means in communication with said linear reciprocating means for driving said scrubbing means in a rotational reciprocal motion; and the control mechanism for controlling said driving in communication with said driving means and said fluid supply conduit, the control mechanism comprising: first and second yoke means associated with said driving means, a first pin associated with said first yoke means, said first yoke means having a discontinuity for enabling said first pin to travel within said first yoke means, a second pin disposed on said first yoke means and associated with said second yoke means, said second yoke means having a discontinuity for enabling said second pin to travel within said second yoke means, a pair of chambers having a plurality of ports, at least one of said ports in each chamber being in communication with said supply conduit, at least one of said ports in each chamber being in communication with said linear reciprocating means, means for opening and closing each said port, said opening and closing means being in communication with said supply conduit in each chamber, and said opening and closing means pivotally mounted in said chambers for enabling supply fluid to enter one chamber while enabling fluid to exit the other chamber, both first and second yoke means associated with said opening and closing means for supplying fluid to said linear reciprocating means, and energy storing means disposed on said second yoke means activated in response to movement of said second pin relative to said second yoke means, wherein said first yoke means includes a rotatable element which transfers energy to said energy storing means via said second pin during rotation from a first position to a second position and which receives energy from said energy storing means at a rapid rate once said element has rotated past its second position of rotation such that said opening and closing means enables fluid to enter and exit said chambers in response to the rotation of said yoke means supplying fluid to said linear reciprocating means.

* * * * *